United States Patent [19]

Schutt

[11] Patent Number: 4,855,035

[45] Date of Patent: Aug. 8, 1989

[54] METHOD OF ABATING CORROSION IN CRUDE OIL DISTILLATION UNITS

[75] Inventor: Hans U. Schutt, Houston, Tex.

[73] Assignee: Shell Oil Company, Houston, Tex.

[21] Appl. No.: 244,239

[22] Filed: Sep. 14, 1988

[51] Int. Cl.[4] ..... C10G 9/12; C10G 9/16

[52] U.S. Cl. ..... 208/47; 208/347; 208/48 R; 585/950; 423/DIG. 8

[58] Field of Search ..... 208/47, 347; 585/950; 423/DIG. 8

[56] References Cited

U.S. PATENT DOCUMENTS

| | | | |
|---|---|---|---|
| 1,921,726 | 8/1933 | Brillon | 208/47 |
| 1,952,898 | 3/1934 | Stratford | 208/47 |
| 2,310,837 | 2/1943 | Carpenter et al. | 208/47 |
| 2,920,030 | 1/1960 | Thompson | 208/47 |
| 2,927,076 | 3/1960 | Jolly | 208/47 |
| 2,990,431 | 6/1961 | Cabbage | 208/47 |
| 3,085,851 | 4/1963 | Grimes | 208/47 |
| 3,189,537 | 6/1965 | Carlton | 208/47 |
| 3,516,922 | 6/1970 | Anzilotti | 208/47 |
| 3,547,806 | 12/1970 | Matyear | 208/47 |
| 3,583,901 | 6/1971 | Piehl | 208/47 |
| 3,676,327 | 7/1972 | Foroulis | 208/47 |
| 3,684,687 | 8/1972 | Carr et al. | 208/47 |
| 3,981,780 | 9/1976 | Scherrer et al. | 203/7 |
| 4,220,519 | 9/1980 | Fujita et al. | 585/950 |
| 4,335,059 | 6/1982 | Rizkalla | 260/549 |
| 4,514,281 | 4/1985 | Baument et al. | 208/47 |
| 4,647,366 | 3/1987 | Edmondson | 208/47 |

FOREIGN PATENT DOCUMENTS 60-120788-A 6/1985 Japan .

*Primary Examiner*—H. M. S. Sneed
*Assistant Examiner*—Helane Myers
*Attorney, Agent, or Firm*—Pamela J. McCollough

[57] ABSTRACT

A process for abating corrosion caused by ammonium bisulfate in a crude column overhead transfer line operated at a temperature above the nominal aqueous dew point and in contact with a crude oil feed stream containing sulfur oxides, ammonia and a hydrochloric acid neutralizing amine, which process comprises maintaining a chloride level in said crude oil feed stream sufficient to provide a mole ratio of ammonium chloride to ammonium bisulfate of greater than about 20 in said crude column overhead transfer line.

2 Claims, 1 Drawing Sheet

METHOD OF ABATING CORROSION IN CRUDE OIL DISTILLATION UNITS

FIELD OF THE INVENTION

This invention relates to a process for abating corrosion in the overhead of a crude column.

BACKGROUND OF THE INVENTION

Crude oils are distilled in oil refinery equipment to produce various fractions such as a gasoline fraction, a fuel oil fraction, or a lubricating oil fraction, and others. Corrosion problems are often encountered in the fractionation of crude oil which is carried out in a crude column. Corrosion problems in a crude unit can be due to any one of or a combination of components found in crude oil, chemicals used in the distilling process, and environmental conditions. The present invention is directed to corrosion problems which are due to added chemicals and constituents formed during the actual distillation process. The main impurities in crude oils which contribute to corrosion of the overhead condensing system of distillation units and other structures of the refinery equipment include chloride and sulfur-containing salts, naphthenic and other organic acids and inorganic acids. It is an object of this invention to provide a method for abating corrosion in an atmospheric column overhead system operated at temperatures above the nominal aqueous dew point where unusually severe corrosion is caused by ammonium salts of sulfuric acid.

Acid-forming substances such as sulfur oxides cause severe corrosion of carbon steel from which conventional petroleum refining equipment is constructed. While it would be possible to fabricate refinery equipment from alloys which are less prone to corrosive attack, the cost of such equipment would be inordinately high and would make any process being conducted with such equipment uneconomical.

It is therefore essential to control corrosion and make possible the use of carbon steel as construction material in the overhead condensing systems.

It has now been found that the corrosion in the overhead of a crude column caused by high levels of ammonium bisulfate is abated by maintaining a level of chloride in the feed stream such that the molar ratio of ammonium chloride to ammonium disulfate in the crude column overhead transfer line is greater than about 20.

SUMMARY OF THE INVENTION

A process for abating corrosion caused by ammonium bisulfate in a crude column overhead transfer line operated at a temperature above the nominal aqueous dew point and in contact with a crude oil feed stream containing sulfur oxides, ammonia and a hydrochloric acid neutralizing amine, which process comprises maintaining a chloride level in said crude oil feed stream sufficient to provide a mole ratio of ammonium chloride to ammonium bisulfate of greater than about 20 in said crude column overhead transfer line.

DESCRIPTION OF THE PREFERRED EMBODIMENTS

Figure 1:
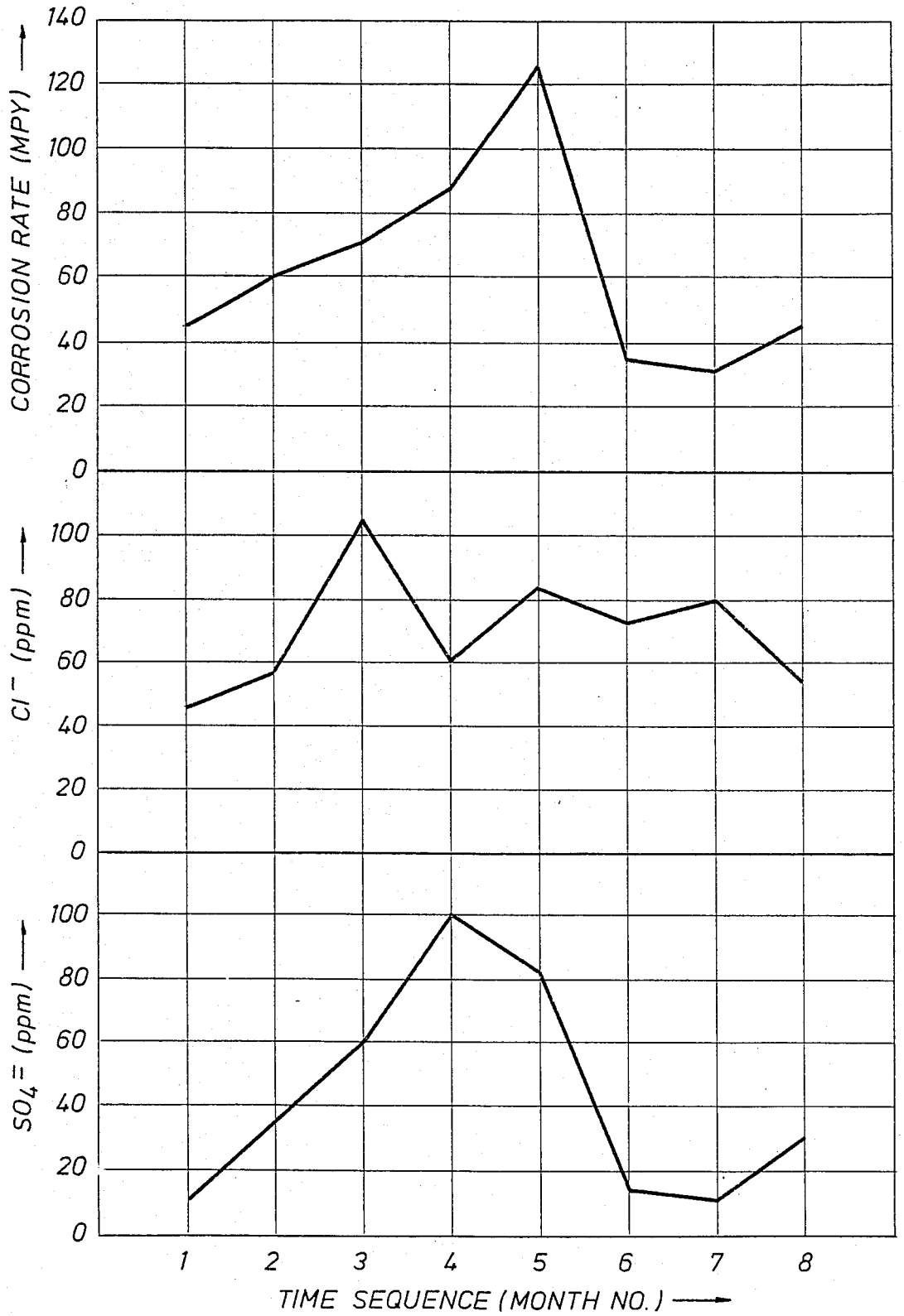

This invention specifically addresses the type of corrosion which takes place when metal comes in contact with sulfur oxides in a crude column overhead operated at temperatures above the nominal aqueous dew point in a substantially anhydrous environment, i.e., where there is a minimum amount of water present. The formation of sulfur oxides in the crude column overhead transfer line may be derived from a wide variety of sources. One source of sulfur oxide contaminants in the feed is the oxidation of sulfides of the event that raw water is used in crude oil desalting. With most crude oils it is necessary to remove the salt from the crude oil by washing with fresh water of a low salinity aqueous phase, imparting a degree of mixing to insure adequate contact between high salinity water entrained by the crude and low salinity wash water and then carrying out the separation process. If the water used in the desalting operation contains oxygen, the sulfur compounds in the crude oil feed stream may be oxidized to form oxides of sulfur. Ultimately, this oxygen may intensify the corrosion potential of the overhead stream by promoting the transformation of sulfides and hydrogen sulfide to sulfate/bisulfate ions.

A second source of sulfur oxides is the deoiling operation. De-oiling can be accomplished by acidifying spent desalter brine with sulfuric acid to a pH of about 3 and returning the resulting hydrocarbon phase to the crude stream.

A third source of sulfur oxides are side streams consisting of slop oils or recovered oils from the various sphase of the distillation process which are recycled to the feed steam.

In the process of the instant invention, the crude column overhead is operated at a temperature above the nominal aqueous dew point and a neutralization agent, such as ammonia in the gaseous phase or as an aqueous solution is injected into the crude column overhead. For overhead columns operated at temperatures above the aqueous dew point, the presence or absence of chloride is crucial. For given chloride and sulfide concentrations at overhead temperatures in excess of the aqueous dew point, ammonium chloride precipitates from the gas phase in a mixture with ammonium salts of sulfur oxides.

The following formula can be used to examine whether crude column overhead conditions in terms of temperature and ammonia partial pressure are conducive to the precipitation of ammonium chloride from the gas phase:

$$NH_4Cl(s) \rightleftharpoons NH_3(g) + HCl(g)$$

$$[P_{HCl}] = \frac{K_p}{[P_{NH3}]}$$

where $$\ln K_p = -\frac{42070}{1.9865 \times T} + 34.2$$

P is the partial pressure in atmospheres and T is the temperature in °K.

All acidic species in the overhead gas stream will eventually be dissolved in the sour water of the overhead accumulator. Since the ratio of the hydrochloric acid partial pressure to the total pressure is equal to the ratio of the number of hydrochloric acid moles to the number of moles of all gaseous species going overhead in a daily cycle, the concentration of chlorides in the sour water of the overhead accumulator which corresponds to the hydrochloric acid partial pressure required for ammonium chloride precipitation, can be calculated. If a chloride analysis of the sour water results in a higher value than the one calculated by the method outlined above, then ammonium chloride precipitation from the gas phase has occurred.

The predominance of ammonium chloride in the hydrocarbon condensed phase with very small amounts of water makes the system amenable to traditional corrosion inhibition approaches. However, if the molar ratio of ammonium chloride to ammonium bisulfate to chloride is less than about 20, a corrosive environment dominated by oxidized sulfur species is created which is not amenable to traditional corrosion inhibition approaches.

Traditional corrosion inhibition approaches for corrosion caused by ammonium chloride include adding neutralizing amines or filming amines to the crude column overhead. Suitable neutralizing amines include ammonia, morpholine, methoxypropylamine, ethylenediamine and the like. Suitable filming amines include amides, diamides, imidazolines and the like.

Although the crude oil per se does not contribute to crude column overhead corrosion, heavy crudes (low API gravity) favor emulsion formation. Consequently, poor phase separations in the desalter and de-oiling vessels lead to the intrusion of relatively high levels of sulfur oxides into the feed going to the column. In addition, at overhead temperatures above the aqueous dew point, sour water, if returned with the column reflux naphtha, will flash off above the aqueous dew point. Such circumstances may create a corrosive environment dominated by oxidized sulfur species. In such an environment where ammonium sulfides and sulfites never precipitate and ammonium chloride may sublime off to a large degree, ammonium bisulfates/sulfates assume greater predominance in the deposits.

Since sulfur-containing acids and their ammonium salts are believed to cause unusually severe corrosion in a crude column overhead operated at a temperature above the aqueous dew point, reduction of the amount of sulfur oxides is effective in mitigating corrosion in the overhead transfer line. The severe corrosion caused by an excess of sulfur oxides in the crude column overhead transfer line can be abated if the molar ratio of ammonium chloride to ammonium bisulfate is maintained above about 20, preferably above about 50. Once the crude column overhead corrosion becomes dominated by chlorides rather than by oxidized sulfur species, traditional overhead corrosion inhibitors based on neutralization of acidity generated by ammonium chloride become effective.

There are several different ways to maintain a low level of bisulfate in the overhead of the crude column. A molar ratio of ammonium chloride to ammonium bisulfate of more than about 20, preferably more than about 50 in the crude column overhead transfer line can be obtained by increasing the amount of chloride in the overhead transfer line or by reducing the bisulfate level in the overhead transfer line.

In order to increase the chloride content in the crude column overhead system, chloride compounds such as, for example, ammonium chloride and the like can be added to the crude column overhead. While the ammonium bisulfate to chloride ratio in the overhead can be maintained by the addition of chloride compounds to the overhead, a preferred method of maintaining an ammonium chloride to ammonium bisulfate molar ratio of more than about 20 is the reduction of sulfur oxides in the overhead of the crude column.

One method for reducing the amount of sulfur oxides in the overhead line is the complete elimination of raw oxygen-containing water, which tends to react with sulfide species or hydrogen sulfide to produce sulfur oxides. A reduction in the amount of ammonium bisulfate in the crude column overhead can also be accomplished by adjusting the pH in the de-oiling process with hydrochloric acid instead of sulfuric acid, thus eliminating another source of sulfur trioxide. A third method of reducing sulfur oxides in the crude column overhead is the neutralization and treatment of sidestreams consisting of slop oil or recovered oil from de-oiling. These sidestreams may be treated, for example, with caustic.

There are at least two sources of free water in the overhead transfer line which should be eliminated to provide a water-free environment. First, an amount of fresh water is injected into the overhead line as solvent for the neutralizing ammonia. In order to eliminate this source of free water, anhydrous ammonia gas instead of an aqueous solution of ammonia can be added to the crude column overhead to dry out the environment. A second source of free water is the sour water returned to the column overhead with the recycled naphtha. This source of free water can be eliminated by improving sour water/naphtha separation in the accumulator or installing a coalescer to minimize water carryover with the reflux naphtha.

In lieu of direct addition of ammonia or a neutralizing amine to the overhead transfer line, the ammonia or neutralizing amine may be added to column reflux naphtha to improve kinetics of sulfur oxide neutralization.

The following examples are intended to further illustrate the invention and are presented without any intention that the invention be limited thereto.

EXAMPLE 1

CORROSION OF CARBON STEEL BY MIXTURES OF AMMONIUM BISULFATE AND AMMONIUM CHLORIDE

The corrosivity of ammonium bisulfate and ammonium chloride mixtures to carbon steel has been evaluated in the presence of relatively small amounts of water, thus simulating possible water carry-over and aqueous ammonia addition under conditions of crude column overhead operations above the aqueous dew point. A series of autoclave tests was conducted where carbon steel coupons were exposed to nitrogen blanketed 43% aqueous salt solutions at 280° F. for a period of 40 hours. Results are summarized in the Table 1.

TABLE 1

Carbon Steel Corrosion Rates as a Function of the Mole Ratio of Ammonium Chloride to Ammonium Bisulfate in the Crude Column Overhead

| Mole Ratio of Ammonium Chloride to Ammonium Bisulfate | Corrosion Rate, mpy |
|---|---|
| ∞ | 580 |
| 62.0 | 560 |
| 20.0 | 650 |
| 8.5 | 1120 |
| 4.3 | 1330 |
| 2.1 | 1940 |
| 1.1 | 2550 |
| 0.2 | 2660 |
| 0 | 3340 |

As can be seen from Table 1, mole ratios of ammonium chloride to ammonium bisulfate less than 20 result in substantial increases in corrosion rates.

EXAMPLE 2

CONDITIONS FOR THE PRECIPITATION OF AMMONIUM CHLORIDE FROM THE GAS PHASE

The following formulas can be used to examine whether crude column overhead conditions in terms of temperature and ammonia partial pressure are conducive to the precipitation of ammonium chloride from the gas phase:

$$NH_4Cl(s) \rightleftharpoons NH_3(g) + HCl(g)$$

$$[P_{HCl}] = \frac{K_p}{[P_{NH_3}]}$$

where $$\ln K_p = -\frac{42070}{1.9865 \times T} + 34.2$$

P is the partial pressure in atmospheres and T is the temperature in °K.

All acidic species in the overhead gas stream will eventually be dissolved in the sour water of the overhead accumulator. Since the ratio of the hydrochloric acid partial pressure to the total pressure is equal to the ratio of the number of hydrochloric acid moles to the number of moles of all gaseous species going overhead in a daily cycle, the concentration of chlorides in the sour water of the overhead accumulator which corresponds to the hydrochloric acid partial pressure required for ammonium chloride precipitation, can be calculated. If a chloride analysis of the sour water results in a higher value than the one calculated by the method outlined above, then ammonium chloride precipitation from the gas phase has occurred.

Four different crude column overhead systems have been considered (see Table 2). Calculated minimum concentrations of chloride in accumulator sour waters indicative of gas phase precipitation of ammonium chloride are 2075 ppm for crude column overhead 1, 4.2 ppm for crude column overhead 2, 6.4 ppm for crude column overhead 3 and 101 ppm for crude column overhead 4. By contrast, actually measured chloride concentrations in the corresponding sour waters are 92 ppm for crude column 1, 9 ppm for crude column 2, 84 ppm for crude column 3 and 230 ppm for crude column 4. Table 2 summarizes conditions in these four crude column overhead systems. Only at crude column 1 did ammonium chloride precipitation not occur. Consequently, high corrosion rates on carbon steel were sustained.

The equilibrium constants Kp for the precipitation of ammonium sulfate and bisulfate are so small that precipitation will have occurred when only parts per billions of sulfate or bisulfate ions are detected in the accumulator sour water.

TABLE 2

| Crude Column Overhead System Parameters | Crude Column Overhead | | | |
|---|---|---|---|---|
| | #1 | #2 | #3 | #4 |
| Carbon Steel Corrosion Rates in Overhead Transfer Line, mpy | = 100 | <5 | <5 | <5 |
| API Gravity of Feed | 13.5° | 29.5° | 18.0° | 23.0° |
| API Gravity of Overhead Naphtha | 54.2° | 74.7° | 58.2° | 55.2° |
| Overhead Temperature, °F. | 300 | 207 | 239 | 260 |
| Aqueous Dew Point, °F. | 200 | 215 | 211 | 178 |
| Operation Above/Below Aqueous Dew Point | above | below | above | above |
| Mole Ratio Stream/Hydrocarbon | 0.51 | 0.27 | 2.3 | 0.21 |
| Ammonium Chloride Precipitation from Gas Phase | no | yes | yes | yes |
| Spent Desalter Brine Deoiling | yes | yes | no | no |
| Ammonia Addition [lbs/day] per (Sour Water Production [M bbl/day] | 70 (1.7) | 121 (1.1) | 175 (1.2) | 200 (1.0) |

EXAMPLE 3

The relationship between corrosion rates in crude column overhead 5 and the chloride and sulfate levels in its accumulator sour water are illustrated in Table 3 and FIG. 1. The column overhead is operated at or slightly below its aqueous dew point of 230° F. Employing the procedure outlined in Example 2, ammonium chloride is expected to precipitate out directly from the gas phase. However, corrosion rates are high because the mole ratio of chloride to sulfate in the total ammonium salt deposit is less than 20. (Only in the seventh month did it approach 20). There obviously exists a strong relationship between the sulfate level and corrosion, but little if any direct correlation with chloride level.

Oxygen entry into the system produced an increase in overhead corrosion. Shifting the desalter wash water from oxygen-free stripped sour water to an oxygenated raw water resulted in a stepwise increase of about 50% in overhead corrosion rates.

TABLE 3

Monthly Average Corrosion Rates as a Function of the Monthly Average Chloride and Sulfate Concentrations in the Accumulator Sour Water

| Time Sequence (Month No.) | Sulfate Concentration (ppm) | Chloride Concentration (ppm) | Corrosion Rate (mpy) |
|---|---|---|---|
| 1 | 10 | 43 | 43 |
| 2 | 37 | 58 | 60 |
| 3 | 60 | 105 | 65 |
| 4 | 100 | 60 | 88 |

TABLE 3-continued

Monthly Average Corrosion Rates as a Function of the Monthly Average Chloride and Sulfate Concentrations in the Accumulator Sour Water

| Time Sequence (Month No.) | Sulfate Concentration (ppm) | Chloride Concentration (ppm) | Corrosion Rate (mpy) |
|---|---|---|---|
| 5 | 82 | 83 | 123 |
| 6 | 12 | 73 | 35 |
| 7 | 10 | 80 | 32 |
| 8 | 30 | 52 | 43 |

FIG.1

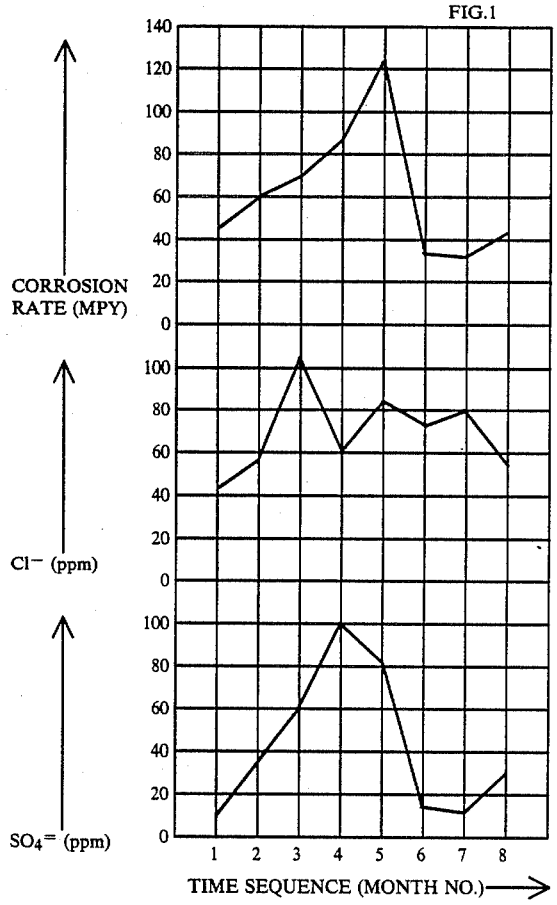

What is claimed is:

1. In a process for abating corrosion in a crude column overhead transfer line operated at a temperature above the nominal aqueous dew point in contact with a crude oil feed stream containing sulfur oxides, ammonia and a hydrochloric acid neutralizing corrosion inhibitor thus forming ammonium chloride and ammonium bisulfate the improvement which comprises maintaining a chloride level in said crude oil feed stream sufficient to provide a mole ratio of ammonium chloride to ammonium bisulfate of greater than about 20 in said crude column overhead system.

2. The process of claim 1 wherein said mole ratio of ammonium chloride to ammonium bisulfate in said crude column overhead transfer line is greater than about 50.

* * * * *